United States Patent [19]

Odendaal

[11] 4,371,289

[45] Feb. 1, 1983

[54] UNDERGROUND ROCK CHUTES

[75] Inventor: David F. Odendaal, Johannesburg, South Africa

[73] Assignee: Gold Fields Mining and Development Limited, Johannesburg, South Africa

[21] Appl. No.: 157,923

[22] Filed: Jun. 6, 1980

[30] Foreign Application Priority Data

Jun. 12, 1979 [ZA] South Africa ..... 79/2899

[51] Int. Cl.[3] ..... E21D 11/00

[52] U.S. Cl. ..... 405/150; 52/506

[58] Field of Search ..... 305/132, 133, 146, 150; 52/249, 506, 510, 598; 193/2 R; 406/193

[56] References Cited

U.S. PATENT DOCUMENTS 1,813,790 7/1931 Wildish ..... 52/506

4,191,492 3/1980 Cobbs ..... 405/133

FOREIGN PATENT DOCUMENTS 503809 7/1931 Fed. Rep. of Germany ..... 405/150

1225127 9/1966 Fed. Rep. of Germany ..... 405/133

*Primary Examiner*—William F. Pate, III

*Assistant Examiner*—Nancy J. Pistel

*Attorney, Agent, or Firm*—Ladas & Parry

[57] ABSTRACT

A rock pass bored in rock is lined with cylinders 10 which are stacked one on top of the other. The liners are lined in those parts which are subject to wear with detachable liners 15. The remainder carries rails 14 as a protection against rebound.

4 Claims, 6 Drawing Figures

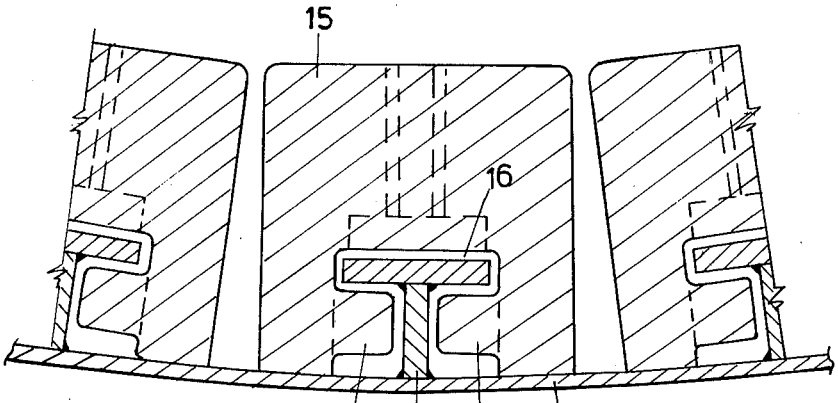
FIG_3
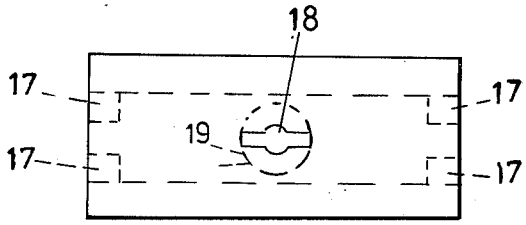
FIG_4
FIG_5
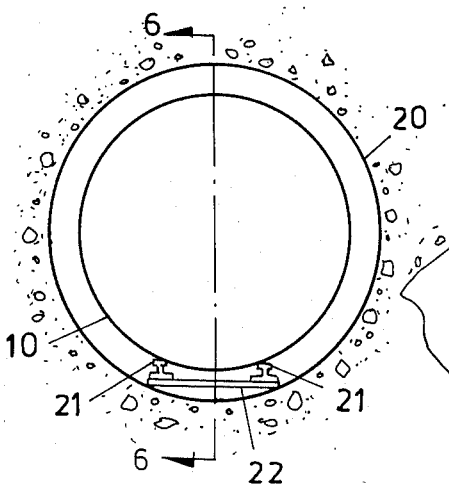
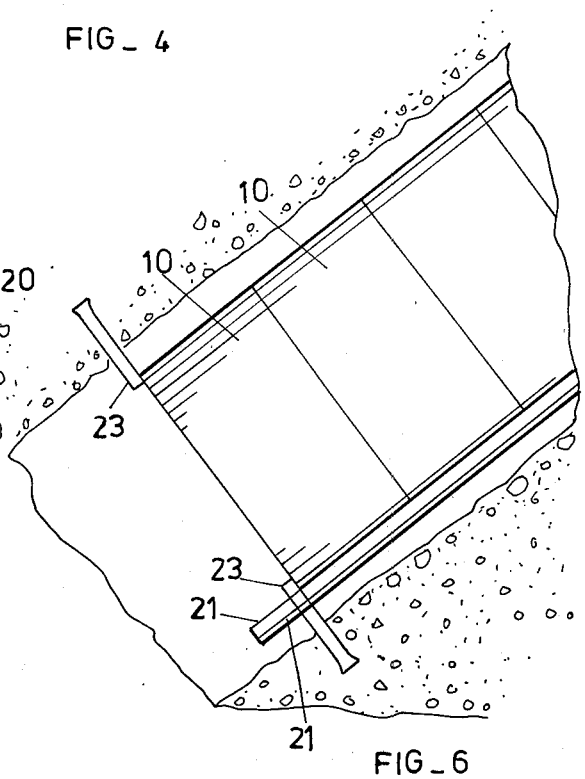
FIG_6

UNDERGROUND ROCK CHUTES

BACKGROUND OF THE INVENTION

This invention relates to underground rock chutes.

Conventionally underground rock chutes are formed by excavating raises or winzes by conventional blasting or by raise boring from one level in a mine to another. If the integrity of the rock through which the chute passes allows it, the unlined chute may be used. However, in bad ground it is necessary to line and re-inforce the walls of the chute.

An object of the invention is to provide a lining system which is relatively easy to install and which in the preferred embodiments of the invention leads to easy replacement of worn parts.

SUMMARY OF THE INVENTION

According to the invention a method of lining a rock pass bored in rock comprises the steps of stacking a series of open-ended cylinders along the length of the pass and lining at least those parts of each cylinder which are subject to most wear with detachable liners.

Further according to the invention the cylinders are of a lesser diameter than the pass, rails are installed in the pass and the cylinders are slid into position along the rails. The space between the cylinders and the rock wall is then filled with grouting.

The invention also provides cylinders adapted to lie in a pass in abutting relationship and each being provided on at least a sector of its inner periphery with cleats for detachably receiving cylinder liners. The cleats are preferably headed and engage in slots on the undersides of the liners, which slots are lipped so that on axial movement of the liners, the latter are held against radial separation from the cleats.

The invention further provides that the unlined parts of cylinder carry headed rails to protect the cylinder walls against rebound.

In the preferred form of the invention the pass is inclined so that only the lower sector of each cylinder need be lined.

DESCRIPTION OF THE DRAWINGS

FIG. 3 is an enlarged section of a liner in position on a cylinder,

FIG. 4 is a top view of a liner,

FIG. 5 is a diagrammatic cross-section of a rock pass, and

FIG. 6 is a fragmentary section along the line 6—6 in FIG. 5.

DESCRIPTION OF A PREFERRED EMBODIMENT

Figure 1:
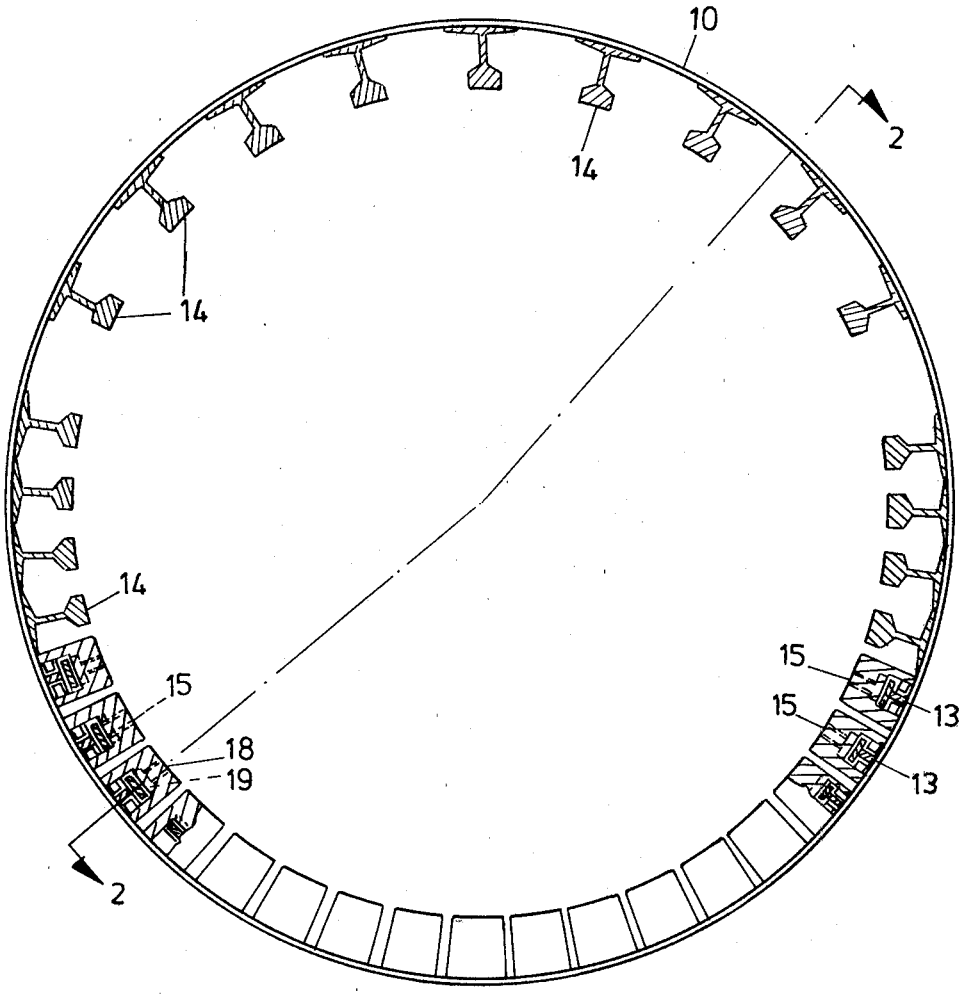
FIG. 1 is a section through a cylinder for lining a rock pass.
Figure 2:
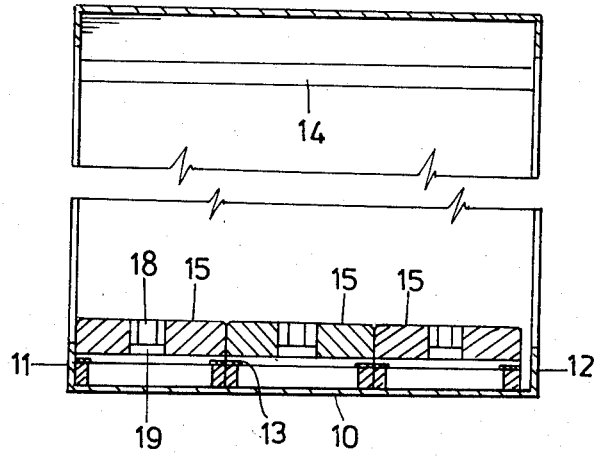
FIG. 2 is a section on the line 2—2 of FIG. 1.

The cylinder illustrated in FIGS. 1 and 2 consists of a mild steel shell 10 fitted with annular stop rings 11 and 12, cleats 13 and rails 14. The cleats 13 are headed and are positioned in the lower sector of the cylinder for taking manganese steel liners 15.

Each liner 15 is cast with a slot 16 in its base and which slot fits over the heads of cleats 13 (see also FIGS. 3 and 4). At each end the slot 16 is formed with an inwardly projecting lip 17 so that when the liner 15 is correctly positioned, it cannot be separated in the radial direction from a pair of cleats 13. In addition each liner 15 is provided with a double keyhole 18 terminating in a circular recess 19. Thus a pronged tool may be inserted into the keyhole 18 and turned to engage the liner 15 for manipulation and handling. As can be seen from FIG. 2 the stop ring 12 is spaced from the nearest cleat 13 a sufficient distance for a lip 17 to be a clearance fit between them. Thus by moving the liners 15 to the right in FIG. 2, they may be removed and replaced as required.

FIGS. 5 and 6 show the use of the cylinders of FIGS. 1 and 2 in a bored raise 20. The first step after boring the raise 20 is to install a pair of parallel rails 21 which are spaced apart by means of rungs 22. The rails 21 serve to guide the shells 10, while the rungs 22 serve as a ladderway for the personnel installing the system. The rails and rungs are rockbolted to the wall of the raise 20.

At the end of a raise 20 a series of rock bolts are provided in the raise 20 for the abutment of a stop ring 11. After the first shell 10 abuts the bolts 23, the other shells 10 are threaded down the raise 20 up to the next level. Each shell 10 in turn is fitted with its liners 15 in the course of installation. When all the shells 10 are in position the space between them and the raise 20 may be grouted.

As and when liners 15 wear out, they may be replaced with relative ease. To facilitate this the liners are marked, either by stamping or by paint colour combinations to allow for easy identification of their location.

I claim:

1. A cylindrical section for lining a rock pass, said cylindrical section being intended for coaxial mounting with a plurality of similar sections and having inwardly directed means for receiving and retaining liner means, liner means, said receiving and retaining means comprising fixed enlarged headed cleats extending inwardly from the cylindrical section, complementary fastener means for permitting the liner means to slide on and interlock with said cleats, in such manner that said liner means presents a substantially flush inwardly directed surface and whereby said liner means may be replaced from within the cylindrical section.

2. A cylindrical section according to claim 1, wherein the cleats are located in a sector of the cylindrical section.

3. A cylindrical section according to claim 2, wherein rail members are provided at locations of the cylindrical section not occupied by cleats.

4. A cylindrical section according to claim 1, wherein the headed cleats engage in slots on the undersides of the liner means, the slots being lipped so that on axial movement of the liner means the latter are held against radial separation from the headed cleats.

* * * * *